United States Patent [19]

Shtanko et al.

[11] 4,220,509

[45] Sep. 2, 1980

[54] ELECTROLYTE FOR ELECTROCHEMICAL POLISHING OF ARTICLES MADE OF TITANIUM AND TITANIUM ALLOYS

[76] Inventors: Vladlen M. Shtanko, ulitsa Vorovskogo, 17v, kv. 31; Pavel P. Karyazin, ulitsa Vorovskogo, 17v, kv. 34; Sergei N. Sirotkin, ulitsa Gagarina, 62a, kv. 26, all of Chelyabinsk; Jury A. Perimov, prospekt Mira, 21a, kv. 39, Kirovo-Chepetsk Kirovskoi oblasti; Vladimir F. Udaltsov, ulitsa Pervomaiskaya, 7, kv. 31, Kirovo-Chepetsk Kirovskoi oblasti; Nina A. Shut, prospekt Dzerzhinskogo, 7, kv. 14, Kirovo-Chepetsk Kirovskoi oblasti; Natalya N. Khukhareva, ulitsa Gagarina, 52, kv. 26, Chelyabinsk, all of U.S.S.R.

[21] Appl. No.: 62,130

[22] Filed: Jul. 30, 1979

[51] Int. Cl.[2] ..... C25F 3/16; C25F 3/18

[52] U.S. Cl. ..... 204/129.95

[58] Field of Search ..... 204/129.95, 129.85, 204/DIG. 2

[56] References Cited

U.S. PATENT DOCUMENTS

| | | | |
|---|---|---|---|
| 3,239,440 | 3/1966 | Covington | 204/129.95 |
| 3,632,490 | 1/1972 | Covington | 204/129.95 |

FOREIGN PATENT DOCUMENTS

| | | | |
|---|---|---|---|
| 370271 | 4/1973 | U.S.S.R. | 204/129.95 |

*Primary Examiner*—T. M. Tufariello

*Attorney, Agent, or Firm*—Lackenbach, Lilling & Siegel

[57] ABSTRACT

Electrolyte for electrochemical polishing of articles made of titanium and titanium alloys contains 45–70 wt.-% sulphuric acid, 4–20 wt.-% nitric acid, 20–35 wt.-% hydrofluoric acid, 0.4–1.9 wt.-% sodium salt of L-sulphocarboxylic acid containing 17 to 20 atoms of carbon in combination with 0.1–1.6 wt.-% sodium salt of carboxylic acid containing 17 to 20 atoms of carbon or 1–2 wt.-% alkyl sulphoureid, 4–20 wt.-% water.

The present invention increases by 20% the dispersive capacity of the electrolyte which produces a high surface finish on the article, uniformity of the electric potential and improves corrosion resistance of the treated article.

4 Claims, No Drawings

ELECTROLYTE FOR ELECTROCHEMICAL POLISHING OF ARTICLES MADE OF TITANIUM AND TITANIUM ALLOYS

The present invention relates to electrochemical treatment of metals and, more particularly, to electrolytes for electrochemical polishing of articles made of titanium and titanium alloys.

FIELD OF APPLICATION

The present invention will be useful in medical engineerring for treatment articles of a complex configuration, e.g. for the surface finish and homogeneity of the surface of, for example, artificial cardiac valves made of titanium and titanium alloys with aluminum, nickel and tungsten additions. Besides, the present invention will be extensively used in ship-building, aircraft and instrument-building industries for processing various articles and parts of complicated shape made of titanium and its alloys.

BACKGROUND OF THE INVENTION

Known in the prior art is a series of electrolytes for electrochemical polishing of titanium and its alloys consisting of mixtures of mineral acids and salts. For example, a prior art electrolyte has the following formula (wt.-%):

nitric acid: 30–52
sulphuric acid: 10–75
hydrofluoric acid: 1–30
phosphoric acid: 0–25
water: 0–25

A considerable disadvantage of the quoted electrolyte lies in a poor dispersive capacity which fails to ensure uniform removal of metal from all the planes on the surface of the article. This leads to nonuniform polishing of the surface and to distortion of the preset geometrical shape of the article.

Besides, the presence of a large amount of nitric acid in electrolyte conduces to an overly deep passivation of the surface of the article. A specimen of titanium treated in this electrolyte features an insufficiently high surface finish (V10) and surface lustre (62%). The process takes too much time (T=180 s) at an anode current density Da=80 A/dm$^2$ and an electrolyte temperature of 30° C.

Another known electrolyte contains the following components (wt.-%):

sulphuric acid: 60–65
hydrofluoric acid: 20–25
glycerin: 10–20

This electrolyte is known for a low conductivity which results in considerable overheating of both the electrolyte and the workpiece, oxidation of the surface being polished and formation of iridescent films on the workpiece in the air as well in the loss of marketable appearance.

One more electrolyte has the following formula:

ortho-phosphoric acid: 800 g/l
sulphuric acid: 90 g/l
inhibitor: 5–10 g/l
monosubstituted potassium phosphate (K $H_2PO_4$): 15 g/l
disubstituted sodium phosphate ($Na_2HPO_4$): 15 g/l.

The absence in this electrolyte of activating fluorine or chlorine ions conduces to a very low rate of anodic dissolution of metal and to an utterly insufficient smoothing of the microscopic surface irregularities.

A further type of electrolyte has the formula (wt.-%):

hydrofluoric acid: 9
magnesium sulphate: 55
water: 13
sulphoacid: 1.0
propyl naphthalene: balance.

This electrolyte is too viscous and overheats considerably which reduces its dispersive capacity. The treatment of titanium articles in the known electrolyte consisting of (wt.-%):

sulphuric acid: 86–93
hydrofluoric acid: 1.5–4
water: 5.5–10 is practically impossible since due to a negligble proportion of hydrofluoric acid, the current is very weak and is characterized largely on the selective dissolution of metal. This results in the damaged surface of a article.

It often happens that the recommended electrolytes with perchloric acid additions are an explosion hazard. Thus, the known electrolytes possessing the above disadvantages fail to produce smooth and levelled out surfaces after electrochemical treatment.

An object of the present invention resides in eliminating the aforesaid disadvantages.

Another object of the present invention resides in providing an electrolyte which would permit increasing the homogeneity and surface finish during electrochemical polishing of articles made of titanium and its alloys.

BRIEF DESCRIPTION OF THE INVENTION

This objects of the invention are accomplished by providing an electrolyte for electrochemical polishing of articles made of titanium and its alloys comprising aqueous solutions of sulphuric, nitric and hydrofluoric acids which, according to the present invention, additionally contain a surface active agent consisting of a mixture of sodium salt of L-sulphocarboxylic acid comprising 17 to 20 atoms of carbon and a sodium salt of a carboxylic acid comprising 17 to 20 atoms of carbon, or alkyl sulphoureid, said components being contained in the following proportions (wt.-%):

sulphuric acid: 45–70
nitric acid: 4–20
hydrofluoric acid: 20–35
sodium salt of L-sulphocarboxylic acid containing 17 to 20 atoms of carbon: 0.4–1.9
with sodium salt of carboxylic acid containing 17 to 20 atoms of carbon: 0.1–1.6;
or alkyl sulphoureid: 1–2
water: 4–20

The present invention increases the dispersive capacity of electrolyte 20% so that the claimed electrolyte produces a surface with a high class of surface finish with a uniform electrochemical potential. The surface is covered with a better oxide film which raises the corrosion resistance of the treated article by 20–30%.

The disclosed electrolyte used for electrochemical polishing of artificial cardiac valves made of titanium and its alloys imparts to said valves specific physical and chemical properties which rule out thrombogenesis and decreases the time of implantation.

The use of the disclosed electrolyte for electrochemical polishing of artificial cardiac valves made of titanium makes it possible to intensify considerably the process of finish working of the article and to reduce by 30% the amount of manual labor required.

Other objects and advantages of the present invention will become apparent from the following detailed description of an electrolyte for electrochemical polishing of articles made of titanium and its alloys and from the examples of preparation of said electrolyte.

DETAILED DESCRIPTION OF THE INVENTION

The expediency of electrochemical polishing of articles made of titanium and its alloys in an aqueous solution of sulphuric, hydrofluoric and nitric acids mixed in the above-mentioned proportions ensues from the knowledge of the properties inherent in each selected acid, such as, for example, hydrofluoric acid as an activating agent which taken in the quantity of 20–35 percent by weight ensures dissolution of the passive film on the surface of the titanium anode. The necessity for introducing 45–70 percent by weight of sulphuric acid is explained by its ability of uniformly and rapidly dissolving the metal of the anode. The addition of a comparatively small amount (4–20 percent by weight) of nitric acid characterized by oxidizing properties conduces to a certain passivation of the surface of the metal being treated, rules out violent and nonuniform dissolution of metal which passes, as it is known, through the stage of forming and subsequent dissolving of an oxide.

The optimum relationship of the electrolyte components is confirmed by a study of the stationary potentials of titanium in the solutions with recommended concentrations. It is just this relationship of components which ensures the best corrosion properties of the medium.

The introduction of surface active agents into the electrolyte based on the mixture of sulphuric, hydrofluoric and nitric acids is conducive to more favorable progress of the electrochemical treatment.

It is commonly known that the boundary "metal-electrolyte" always produces the so-called double electrical layer. The capacity of this double electrical layer gives an idea of the value of the potential barrier on the path of the reaction of anodic dissolution of the metal. In the course of polishing in an electrolyte with the addition of the disclosed surface active agents (sodium salts of L-sulphocarboxylic acids in combination with sodium salts of carboxylic acids or alkyl sulphoureid) the double electrical layer is reconstructed which is accompanied by a substantial reduction of its capacity. For example, on adding 0.4 percent by weight of sodium salt of L-sulphocarboxylic acid in combination with 0.1 percent by weight of the sodium salt of carboxylic acid, the capacity of the double electrical layer drops from 46 mfd/cm$^2$ to 8–12 mfd/cm$^2$. This is a phenomenon of synergism. The surface of the metal being polished becomes coated with a viscous film of a perfect structure which ensures uniform removal of metal and prevents pin-point damage of the surface. Concurrently the dispersive capacity of the electrolyte and the lustre of the workpiece surface are substantially improved.

The process of electrochemical treatment if considerably intensified (by 3 times). For the sodium salts of L-sulphocarboxylic acids we suggest the use of mono- or disodium salts of sulpho-carboxylic acids (stearic, nonadecylic, arachidonic and eicosane-carboxylic acids) with a structural formula:

$$C_n H_{2n+1}-\underset{\underset{SO_3Na}{|}}{CH}-COOH \text{ or } C_n H_{2n+1}-\underset{\underset{SO_3Na}{|}}{CH}-COONa$$

In combination with these salts we use the corresponding salts of carboxylic acids, e.g. stearates, caproates, milstates with a structural formula:

$$C_n H_{2n+1}-COONa.$$

Alkyl sulphoureid is a derivative of L-sulphocarboxylic acids based on urea when the atom of hydrogen of amine group is substituted by the acidic residue of sulphonic acid. It structural formula:

$$C_nH_{2n+1}-\underset{\underset{SO_3H}{|}}{CH}-CO-NH\ CO\ NH_2$$

When this substance is used as a surface-active agent we suggest that it should be introduced into the electrolyte at the rate of 1 to 2 percent by weight.

The specific adsorption of the surface-active agents to which the above-mentioned compounds of this class belong produces uniform removal of metal over the entire surface of the workpiece.

Besides, the disclosed additions of surface-active substances are nontoxic and do not require special detoxication. The favorable effect of electrochemical polishing of articles in the electrolyte of the suggested composition is achieved only with the introduction of the surface-active additives in the quantities stipulated in the formulas.

If the quantity of surface-active additives is lower than the disclosed limit, the above-listed favorable effects (increased dispersive capacity of electrolyte, the phenomenon of synergism, improvement in the surface finish and lustre of the article) either diminish or vanish altogether.

Conversely, the introduction of a larger quantity of sodium salts of L-sulphocarboxylic acids in combination with sodium salts of carboxylic acids or alkyl sulphoureid is not practicable since it does not produce any additional effect.

The electrochemical treatment of articles in the disclosed electrolyte should be carried out under the following technological conditions:

anode current density: 80–100 A/dm$^2$
voltage: 8–15 V
electrolyte temperature: 20°–40° C.
polishing time: 30–60 s

EXAMPLE 1

Artificial cardiac valves of titanium are electrochemically treated in the solution of the following composition (wt.-%):

sulphuric acid: 45
hydrofluoric acid: 35
nitric acid: 4
water: 15
sodium salt of arachidonic acid: 0.6
sodium salt of corresponding L-sulphocarboxylic acid: 0.4

Treatment conditions:

anode current density Da=80) A/dm$^2$
voltage U=8 V
electrolyte temperature t=20° C.
polishing time T=45 s As a result, the article becomes lustrous and the surface finish is V 13.

The lustre of the polished article is 65%.

EXAMPLE 2

The closing element of an artificial cardiac valve made of titanium-based alloy with aluminum is treated in the following solution (wt.-%):
sulphuric acid: 55
hydrofluoric acid: 24
nitric acid: 9
water: 10
sulphoureid: 2
Treatment conditions:
anode current density Da=100 A/dm$^2$
voltage U=15 V
electrolyte temperature t=40° C.
polishing time T=30 s
The surface finish of the article is V12
The lustre of the polished article is 70%.

EXAMPLE 3

An article of titanium alloy with added nickel is treated in the following solution (wt.-%):
sulphuric acid: 70
hydrofluoric acid: 20
nitric acid: 4
water: 5
sodium salt of stearic acid: 1.6
sodium salt of corresponding L-sulphocarboxylic acid: 0.4
Treatment conditions:
anode current density Da=80 A/dm$^2$
voltage U=10 V
electrolyte temperature t=30° C.
polishing time T=35 s
The surface finish of the article has grown to V14.
The lustre of the surface is 78%.

EXAMPLE 4

A specimen made of a titanium alloy with tungsten has been electrochemically treated in the following solution (wt.-%):
sulphuric acid: 45
hydrofluoric acid: 20
nitric acid: 20
water: 14
sodium salt of eicosane carboxylic acid: 0.5
sodium salt of corresponding L-sulphocarboxylic acid: 0.5
Treatment conditions:
anode current density Da=80 A/dm$^2$
voltage U=8 V
electrolyte temperature t=20° C.
polishing time T=60 s
The surface finish of the article has increased to V12.
The lustre of the surface is 67%.

EXAMPLE 5

An article made of technically pure titanium has been treated in the following electrolyte (wt.-%):
sulphuric acid: 45
hydrofluoric acid: 20
nitric acid: 14
water: 20
sodium salt of nonadecylic acid: 1.9
sodium salt of corresponding L-sulphocarboxylic acid: 0.1
Treatment conditions:
anode current density Da=90 A/dm$^2$
voltage U=10 V
electrolyte temperature t=22° C.
polishing time T=30 s
The surface finish of the article is V13.
The surface lustre is 86%.

EXAMPLE 6

A specimen made of titanium alloy with an additive of aluminum is treated in the following solution (wt.-%):
sulphuric acid: 68
hydrofluoric acid: 22
nitric acid: 5
water: 4
alkyl sulphoureid: 1
Treatment conditions:
anode current density Da=100 A/dm$^2$
voltage U=12 V
electrolyte temperature t=30° C.
polishing time T=50 s
The surface finish of the article after polishing reached V12.
The surface lustre is 68%.

EXAMPLE 7

Titanium parts are treated electrochemically in electrolyte of the following composition (wt.-%):
sulphuric acid: 68
hydrofluoric acid: 22
nitric acid: 4
water: 4.5
alkyl sulhpoureid: 1.5
Treatment conditions:
anode current density Da=85 A/dm$^2$
voltage U=10 V
Electrolyte temperature t=20° C.
polishing time T=30 s
The obtained surface finish of the polished article is V13.
The surface lustre is 80%.
What is claimed is:

1. Electrolyte for electrochemical polishing of articles made of titanium and titanium alloys, containing:
45–70 percent by weight of sulphuric acid,
4–20 percent by weight of nitric acid,
20–35 percent by weight of hydrofluoric acid,
1–3.5 percent by weight of surface-active agent based on L-sulphocarboxylic acid,
4–20 percent by weight of water.

2. Electrolyte for electrochemical polishing of articles made of titanium and titanium alloys according to claim 1, containing:
45–70 percent by weight of sulphuric acid,
4–20 percent by weight of nitric acid,
20–35 percent by weight of hydrofluoric acid
0.4–1.9 percent by weight of sodium salt of L-sulphocarboxylic acid containing 17 to 20 atoms of carbon in combination with 0.1–1.6 percent by weight of sodium salt of carboxylic acid containing 17 to 20 atoms of carbon,
4–20 percent by weight of water.

3. Electrolyte for electrochemical polishing of articles made of titanium and titanium alloys according to claim 1, containing:
45–70 percent by weight of sulphuric acid,
4–20 percent by weight of nitric acid,
20–35 percent by weight of hydrofluoric acid,
1–2 percent by weight of alkyl sulphoureid,
4–20 percent by weight of water.

4. Electrolyte for electrochemical polishing of articles made of titanium and titanium alloys, according to claim 2, wherein the sodium salts of L-sulphocarboxylic acid are mono- or disodium salts selected from the group consisting of stearic, nonadecylic, arachidonic and eicosane carboxylic acids.

* * * * *